US005500717A

United States Patent [19]

Altrieth, III

[11] Patent Number: 5,500,717

[45] Date of Patent: Mar. 19, 1996

[54] JOB STORAGE/RETRIEVAL SYSTEM AND METHOD FOR REPRODUCTION APPARATUS

[75] Inventor: Frederick E. Altrieth, III, Scottsville, N.Y.

[73] Assignee: Eastman Kodak Company, Rochester, N.Y.

[21] Appl. No.: 398,467

[22] Filed: Mar. 3, 1995

[51] Int. Cl.[6] ..... G03G 21/00

[52] U.S. Cl. ..... 355/209; 345/173; 345/185; 364/188

[58] Field of Search ..... 355/204, 209, 355/210, 203; 364/188, 189; 345/116, 141, 146, 168, 173, 185

[56] References Cited

U.S. PATENT DOCUMENTS 4,970,554 11/1990 Rourke ..... 355/202
5,036,361 7/1991 Filion et al. ..... 355/209
5,049,931 9/1991 Knodt ..... 355/209
5,054,880 9/1991 Evanitsky et al. ..... 355/209 X
5,061,958 10/1991 Bunker et al. ..... 355/209
5,105,220 4/1992 Knodt et al. ..... 355/209
5,390,005 2/1995 Kimoto et al. ..... 355/209

*Primary Examiner*—R. L. Moses
*Attorney, Agent, or Firm*—Lawrence P. Kessler

[57] ABSTRACT

Reproduction apparatus having an improved system for storage and retrieval of a job setup comprising job selected operating features. The apparatus has a display device on which are addressed a features selection screen(s), a job store/retrieve memory screen and a job naming screen. The job naming screen comprises alpha numeric characters, selectable by the operator touch address, to define a word/phrase job name, which is stored in apparatus memory together with the related job operating features signals and a job code number.

14 Claims, 17 Drawing Sheets

JOB STORAGE/RETRIEVAL SYSTEM AND METHOD FOR REPRODUCTION APPARATUS

FIELD OF THE INVENTION

The present invention relates to operator control systems and methods for reproduction apparatus such as electrostatographic copiers or printers and more particularly to improvements in such systems and methods that facilitate the storage and retrieval of reproduction jobs.

BACKGROUND OF THE INVENTION

High speed reproduction apparatus such as electrostatographic copiers and printers have become extremely versatile as to document input and copy output capabilities, as well as to the image adjustments and modifications that can effected. For example, with automatic accessories such as document handlers, sorters, and staplers, such apparatus can operate in various input-output modes, for example simplex-to-simplex, simplex-to-duplex, duplex-to-simplex and duplex-to-duplex and can deliver very high volume outputs in various forms, e.g., stapled, stacked, in bins etc. The apparatus can be set to vary the document copy images, e.g., as to contrast, density, color, size (enlarge-reduce), location (image placement on the page), screening (for continuous tone originals) image reversal (positive-negative), x-and-y scaling, area or edge erasing etc.

Of course, all the above capabilities involve choices which an operator must make (or defer to a nominal setting). Moreover, the operational parameter setup for a given job can include not only the number of copy sets desired and choices about the above parameters, but selections about different portions of the job. For example, a job level selection can be made to effect every page of the job. A page level selection can be made to effect one or more designated pages within the overall job document. And, area level selections can be made to effect changes, e.g., erase or screening, on only certain portions of a particular page.

It can be appreciated from the foregoing that job setup for high speed reproduction apparatus is complex work that even skilled operators find challenging and time consuming. Since "jobs" often involve the production of many document sets, errors can be fairly costly. To ease this situation, various touch-selection screen display devices, showing mode and feature selection options in sequential displays, have been developed, along with prompting instructions displays that are tailored to casual and/or skilled operators (see e.g., U.S. Pat. No. 5,049,931). Such improvements assist operators significantly; however, the "setup" of a complicated job (e.g., with many special selections) still requires significant time and concentration of a skilled operator. For this reason it is desirable to be able to "save" the set-up work that has been accomplished.

U.S. Pat. No. 4,970,554 describes a system employing a machine readable job ticket that contains a job number and instructions for parameter selections for that job. The instructions are filed in memory, accessible by the job number code, and the job ticket is kept with the originals to be reproduced. When reproduction is to occur, the originals are delivered to the reproduction apparatus, and the operator accesses system memory via the job number code to gain the stored parameter selections. This system would be useful for minimizing set-up time for subsequent identical jobs, so long as the job ticket was not lost. However, even if the job ticket is available it is not readily identifiable to the system operator as the unique one among many, that was requested for re-run(s). That is, the job number code will access the control system to set the proper parameters of the reproduction apparatus, but the job number very likely will not register in the operators memory as any particular job. For this reason operators create lists of job code numbers with cryptic short file names to jog their memory about the particular job that is connected with the job code. If the job is used infrequently the operator can easily loose recollection of what the short file names relate to, or the file name lists can be lost or outdated. The operator then is confronted with the unpleasant choices of examining all saved jobs to locate the one with the required set-up, or reprogramming the job from scratch.

SUMMARY OF INVENTION

One significant purpose of the present invention is to provide for complex reproduction apparatus, improved job storage/retrieval systems and methods that will reduce the difficulties described above. For example, systems and methods of the present invention provide a field for writing and displaying an operator-recognizable job description that is storable and retrievable in conjunction with a job code number, which will access the set-up parameters for that job. According to systems and methods of the present invention, such job descriptions can be defined either at the time a job is initially set-up and saved or when a previously saved job is recognized and retrieved.

Thus, in one aspect the present invention constitutes an improvement in reproduction apparatus of the kind having a plurality of operating features for producing copy jobs and an operator control communication interface including: (1) display and memory means for providing a first screen for indicating operating features for job selections (2) signal generators for producing a signals set representing selected operating features and (3) control means for producing a copy job in accord with the selected operating features. The apparatus memory has a means for storing data representing the selected signals set with an associated job number retrieval code and in accord with improvements of the invention the apparatus comprises: (i) memory for providing a second screen display for indicating a plurality job description characters to be chosen by the operator, (ii) means responsive to operator character choices to record a job description, (iii) means for storing the job description in the apparatus memory in retrievable association with the signal set and job number retrieval code and (iv) means responsive to job number retrieval code address for retrieving the signal set and displaying the job description associated therewith.

In another aspect the present invention constitutes an improved method of job description, storage and retrieval for reproduction apparatus of the kind having a plurality of operating features and an operator control communication interface having a screen display for operator selection of such features. The method includes (a) displaying a features screen(s) having selectable operating features, (b) selecting the desired features for a predetermined job, (c) generating a signals set representing such selected features, (d) generating a job number for said predetermined job, (e) displaying a job naming screen having selectable job description characters, (f) selecting characters on said job naming screen to form a visually readable job description for said predetermined job, (g) and storing the signals set, job number and job description for said predetermined job in retrievable association. Thus, the job description will be retrieved and displayed in response to by the operator's accessing of the job number so as to enhance operator recollection of the particular predetermined job, and the associated operating features signals set can be readily utilized to reproduce the predetermined copy job without reprogramming of the reproduction apparatus.

BRIEF DESCRIPTION OF DRAWINGS

The subsequent description of preferred embodiments of the invention refers to the accompanying drawings wherein.

DETAILED DESCRIPTION OF THE INVENTION

Figure 1:
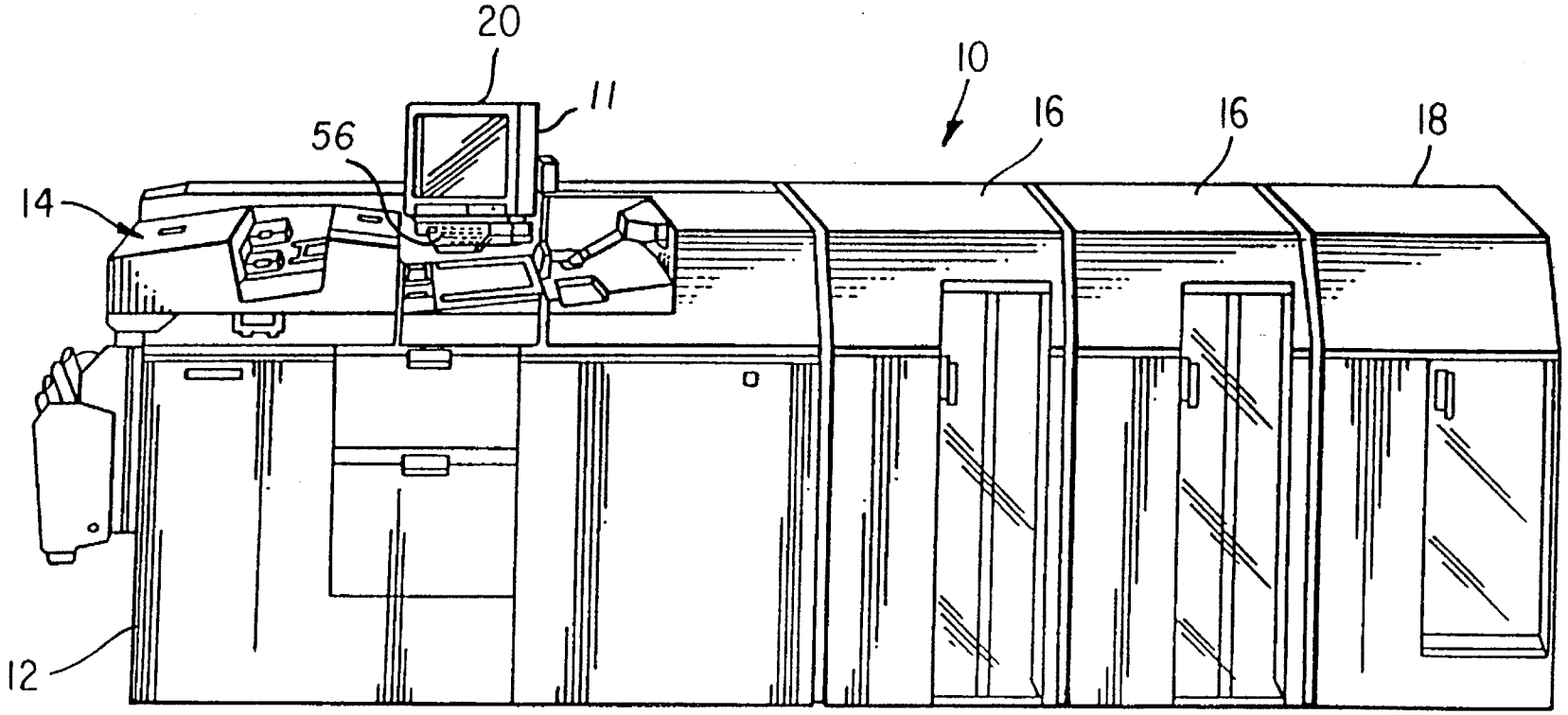
FIG. 1 is a perspective view of a typical reproduction apparatus including an operator control communication interface utilized in improved job storage/retrieval according to the present invention.

Referring now to the accompanying drawings, FIG. 1 shows a typical reproduction apparatus, designated generally by the numeral 10, including an operator control communication interface 20 utilized in simplifying job storage and retrieval according to this invention. The exemplary reproduction apparatus 10 has a marking engine 12 for producing copies of original information, such as original documents circulated by a document feeder 14. Several well known finishing accessories, such as sorters 16 and stacker/stapler 18, are associated with marking engine 12. Of course, other well known marking engines and associated accessories, serving in various configurations as copiers or printers, can be used advantageously with this invention.

Figure 2:
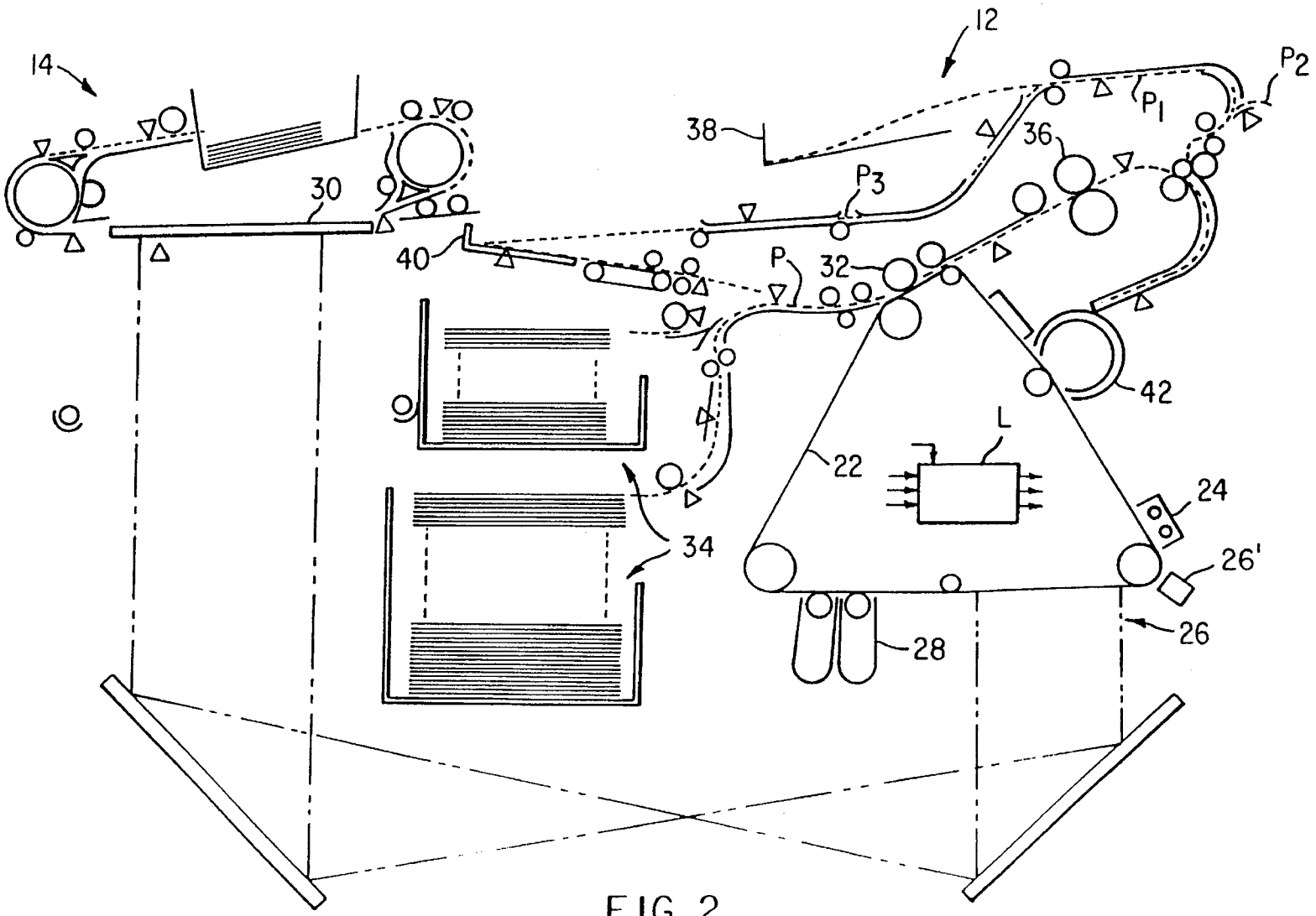
FIG. 2 is a schematic illustration of the paper paths and operating electrophotographic subsystems of the FIG. 1 apparatus.

The basic arrangement and operation of the exemplary marking engine 12 for the reproduction apparatus 10 is shown in reference to FIG. 2 and includes a dielectric support 22, in the form of an endless web, supported for movement about an endless path. In the reproduction cycle, the moving dielectric support 22 is uniformly charged as it moves past a primary charging station 24. Thereafter, the uniformly charged dielectric support passes through an exposure station 26 where the uniform charge is altered to form a latent image charge pattern corresponding to information desired to be reproduced. Depending upon the characteristics of the dielectric support and the overall reproduction system, formation of the latent image charge pattern may be accomplished by exposing the dielectric support 22 to a reflected light image of an original document to be reproduced delivered to a transparent platen 30 by the document feeder 14. Alternatively, formation of the latent image charge pattern may be accomplished by "writing" on the dielectric support with a series of lamps 26' (e.g., LED's or lasers) or point electrodes actuated by electronically generated signals based on the desired information to be reproduced.

The latent image charge pattern on the dielectric support 22 is then brought into association with a development station 28 which applies pigmented marking particles to adhere to the dielectric support to develop the latent image. The portion of the dielectric support 22 carrying the developed image then passes through a transfer station 32 in register with a receiver member fed in proper timed relation from a supply hopper 34 along the path P. An electric field produced in the transfer station 32 attracts the marking particles of the developed image from dielectric support to the receiver member.

The electric transfer field may also cause the receiver member to adhere to the dielectric support 22. Accordingly, a destack mechanism (not shown), immediately downstream in the direction of travel of the dielectric support, is provided to facilitate removal of the receiver member from the dielectric support. The detack mechanism may be, for example, an AC corona charger for neutralizing the attractive field holding the receiver member to the dielectric support. After the developed image is transferred to the receiver member and the receiver member is separated from dielectric support, the receiver member is transported through a fusing device 36 where the image is fixed to the receiver member by heat and/or pressure, for example.

The receiver member bearing the fixed image is then selectively delivered to an appropriate desired output. The output may be directed along the path $P_1$ to a top exit hopper 38 for direct operator retrieval, or along path $P_2$ through a side exit for delivery to one of the output accessories 16, 18. Alternatively, the output may be directed along the path $P_3$ to an intermediate hopper 40, where it is effectively turned over and delivered along the path $P_4$ to return to the transfer station 32 to enable a duplex reproduction to be formed on such receiver member. Simultaneously, with delivery to the desired output, the dielectric support 22 is cleaned of any residual marking particles at cleaning station 42 and returned to the primary charging station 24 for reuse.

The reproduction apparatus 10 has many different user selectable operating features. For example, duplex document booklets may be formed from simplex or duplex original information, or information to be copied may be edited to change its size, content, or orientation. Further examples of selectable operating features where noted in the background section and other exemplary selected operating features are noted in more detail below. It will be appreciated, that with all these communications required between the user and the apparatus and the apparatus and the user, a highly sophisticated communication interface is required.

Figure 3:
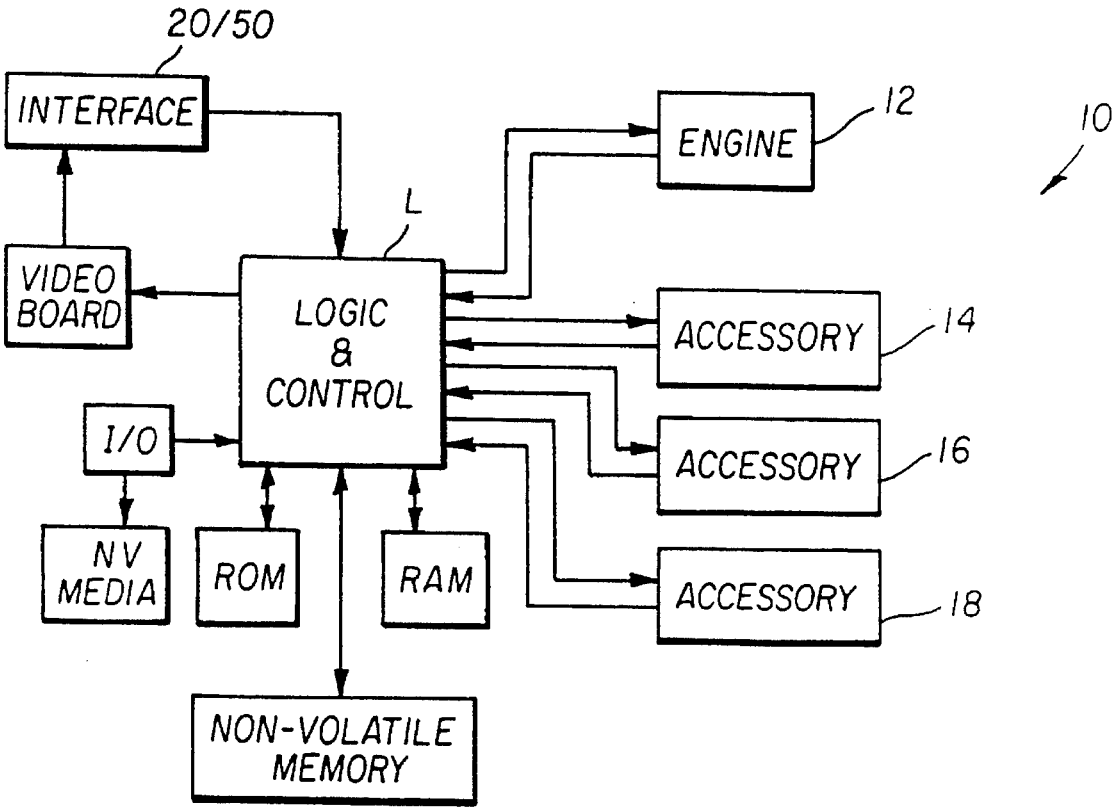
FIG. 3 is a block diagram of the control of the FIG. 1 apparatus.

The operator control communication interface 20 includes, for example, a display device 11 having a touch activated screen with a manually activated keyboard panel 50. The operator control interface 20 is electrically coupled to a logic and control unit L located, for example, within the housing of the reproduction apparatus 10. One logic and control unit L illustrated schematically in FIG. 3, includes a microprocessor based controller electrically coupled to the marking engine and accessories of the reproduction apparatus 10. The controller includes random access memory (RAM), read only memory (ROM), and other non-volatile memory. The controller may also include a reader/writer to non-volatile media, such as a disk. Of course, the operator control interface 20 may alteratively include a stand-alone logic and control unit which would then, in turn, be electrically coupled to the logic and control unit L of the reproduction apparatus 10.

In order to control the reproduction apparatus 10, the controller of the logic and control unit L receives input signals from the operator control communication interface 20 and a plurality of sensors associated in any well known manner with the reproduction apparatus marking engine 12 and accessories 14, 16, and 18. Based on such signals and a program for the microprocessor, the logic and control unit produces appropriate signals to control the various operating devices within the reproduction apparatus. The production of a program for a number of commercially available microprocessors is a conventional skill well understood in the art and does not form a part of this invention. The particular details of any such program would, of course, depend upon the architecture of the designated microprocessor.

Figure 4:
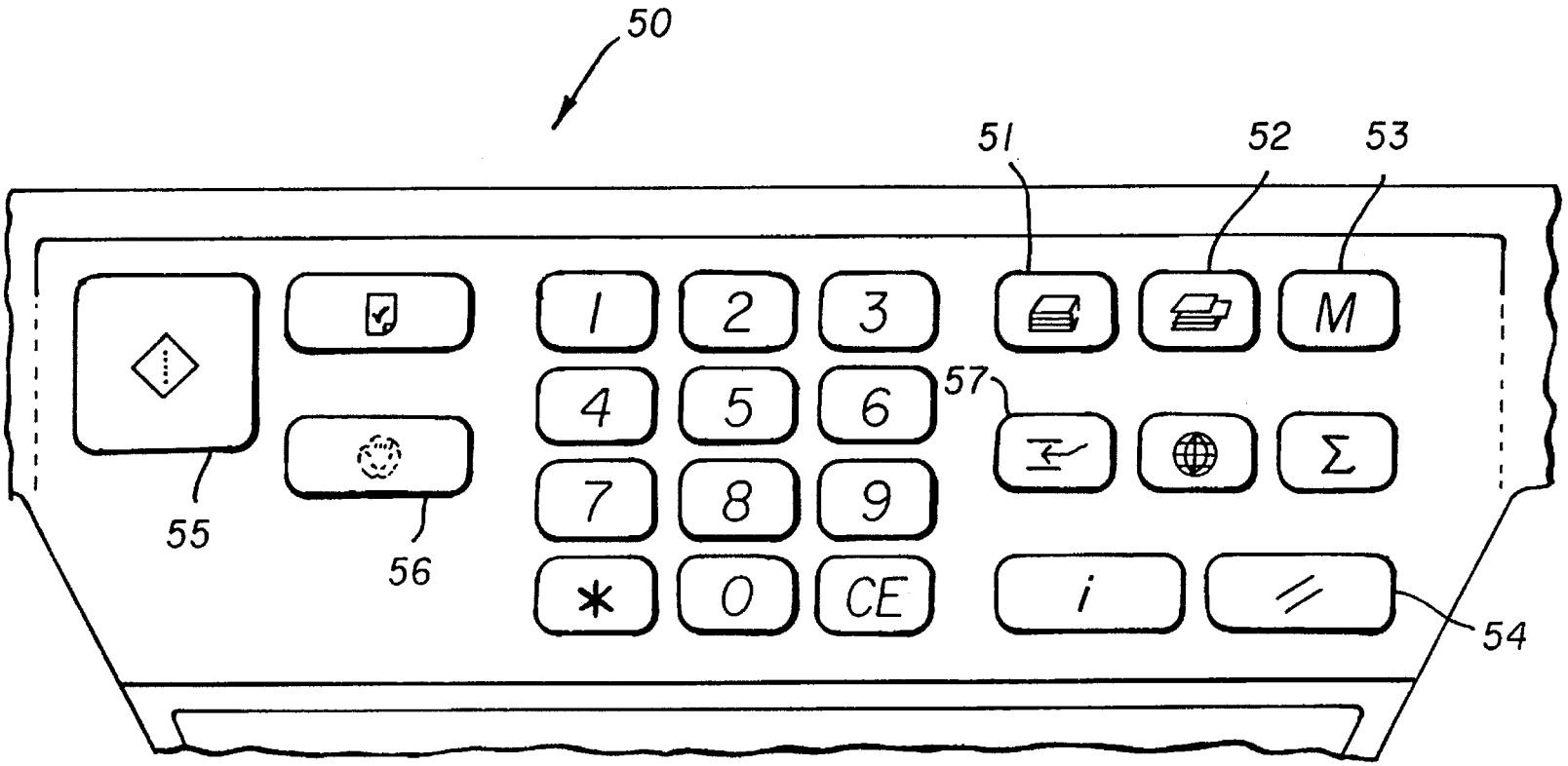
FIG. 4 is an enlarged schematic view of the hard keyboard control panel shown in FIG. 1.

The present invention provides improved structures and modes for the FIG. 1 reproduction apparatus to store and retrieve the data signals representing a complex reproduction job(s), which in this context will comprise a large number of operating feature selections from the vast menu available with the apparatus 10. One preferred combination of hardware and software for use in accord with the invention comprises the hard key panel 50 and touch screen display device 20, shown e.g., in FIGS. 4 and 5, as operable under the control of logic and control system L, with its associated memories and microprocessor. Thus, the hard keyboard panel 50 can comprise, among other mode selection keys, a job level selection mode key 51, a page level selection mode key 52, a memory selection mode key 53, and a reset key 54. Other mode selection keys such as start 55, stop 56, interrupt 57, etc., are provided, but not involved directly with the description of the invention.

Figure 5:
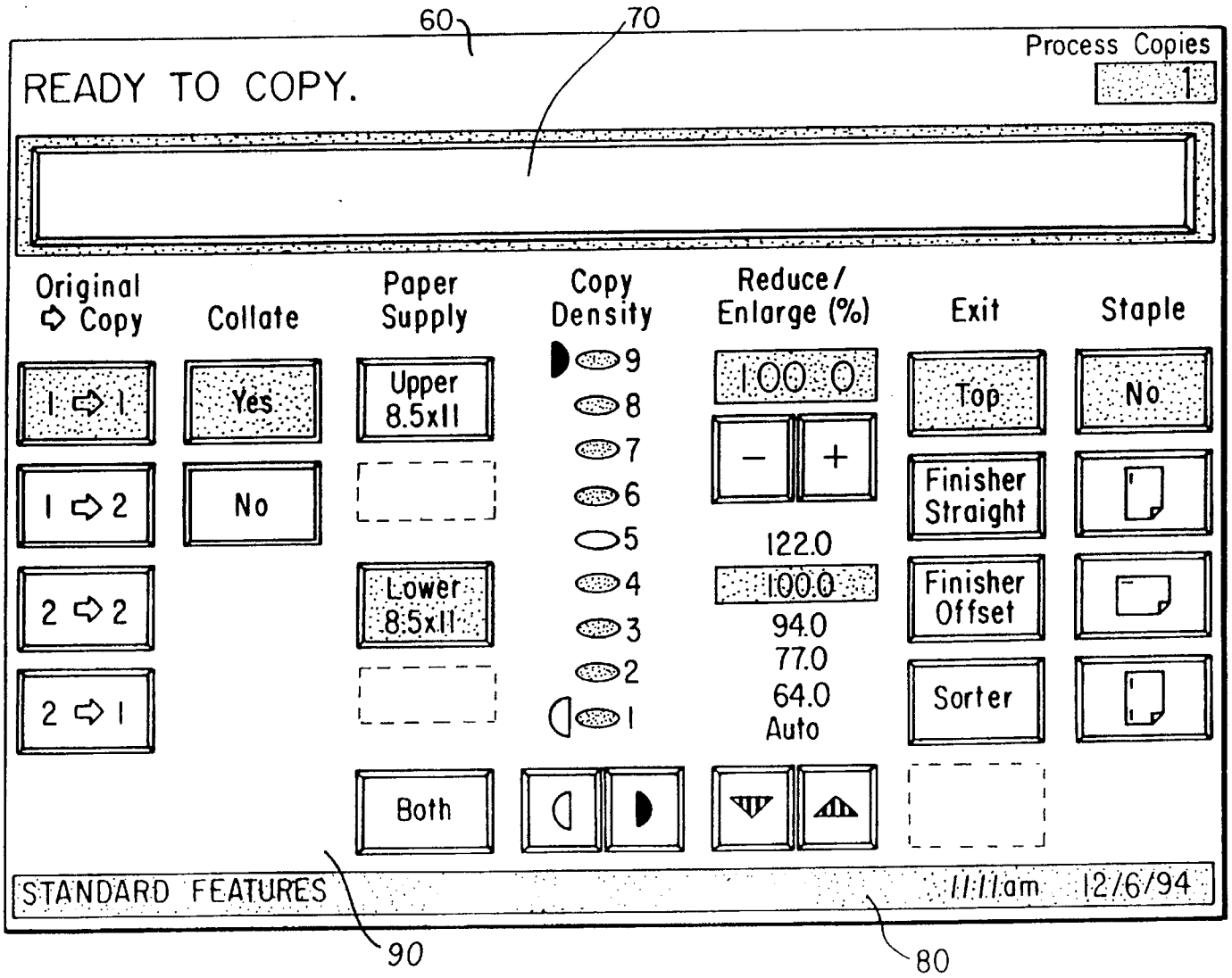
FIG. 5 is a front view of the active display device of the FIG. 1 apparatus showing an operating feature selection screen with a standard features, nominal settings format in accord with one preferred embodiment.
Figure 6:
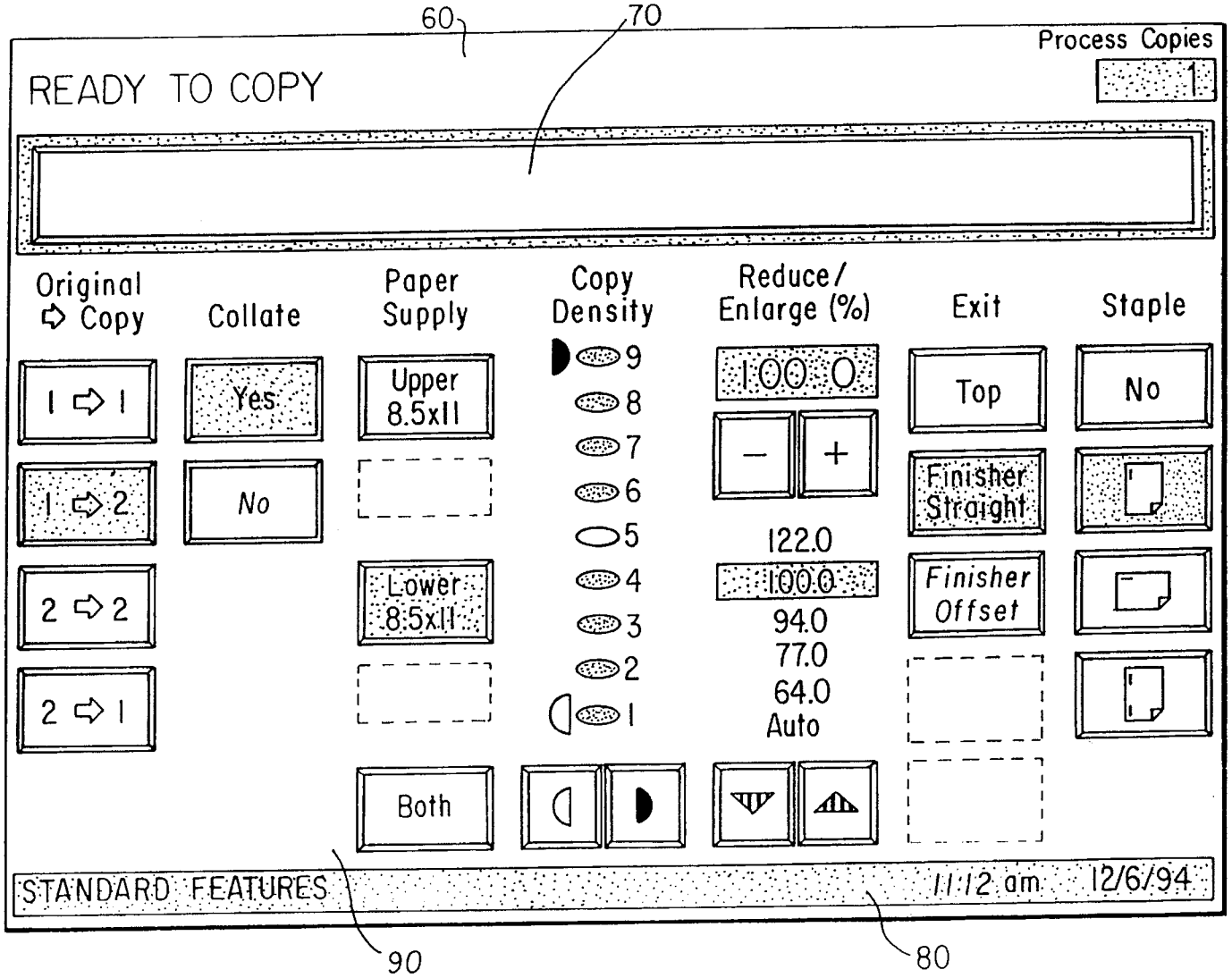
FIG. 6 is a view of the standard operating feature selection screen shown in FIG. 5, with alternative operating feature selections registered.

FIG. 5 shows a standard features screen that is addressed (with nominal selections) onto display device 11 from memory of the logic unit L, in response to the operator pushing the reset key 54 of panel 50 to initiate a new job set-up. In general, the selection screen includes a top banner section 60, a message section 70, a lower banner section 80 and a main display field 90. Section 60 conveys information relative to the general reproduction apparatus status and section 80 conveys the generic name for the information within the main display field 90. Section 70 is available for other operator information or directions. The screens will highlight selected features; and FIG. 5 shows simplex to simplex copy mode, collated, using the lower paper supply (with 8½11 inch paper), an average copy density (5), 100% magnification, copies delivered to the top exit hopper, without staples, which are typical nominal selections presented to the operator at the commencement of job set-up selections. The operator's task is to accept or change these nominal selections as well as to make other selections from subsequent screens called to address upon display device 11. For example, FIG. 6 shows the standard features screen as it would exist when the operator had exercised selection (by touch of designated screen regions) of "simplex original to duplex output", copy output to the "finisher straight" and portrait staple instead of the nominal selections shown in FIG. 5.

Figure 7:
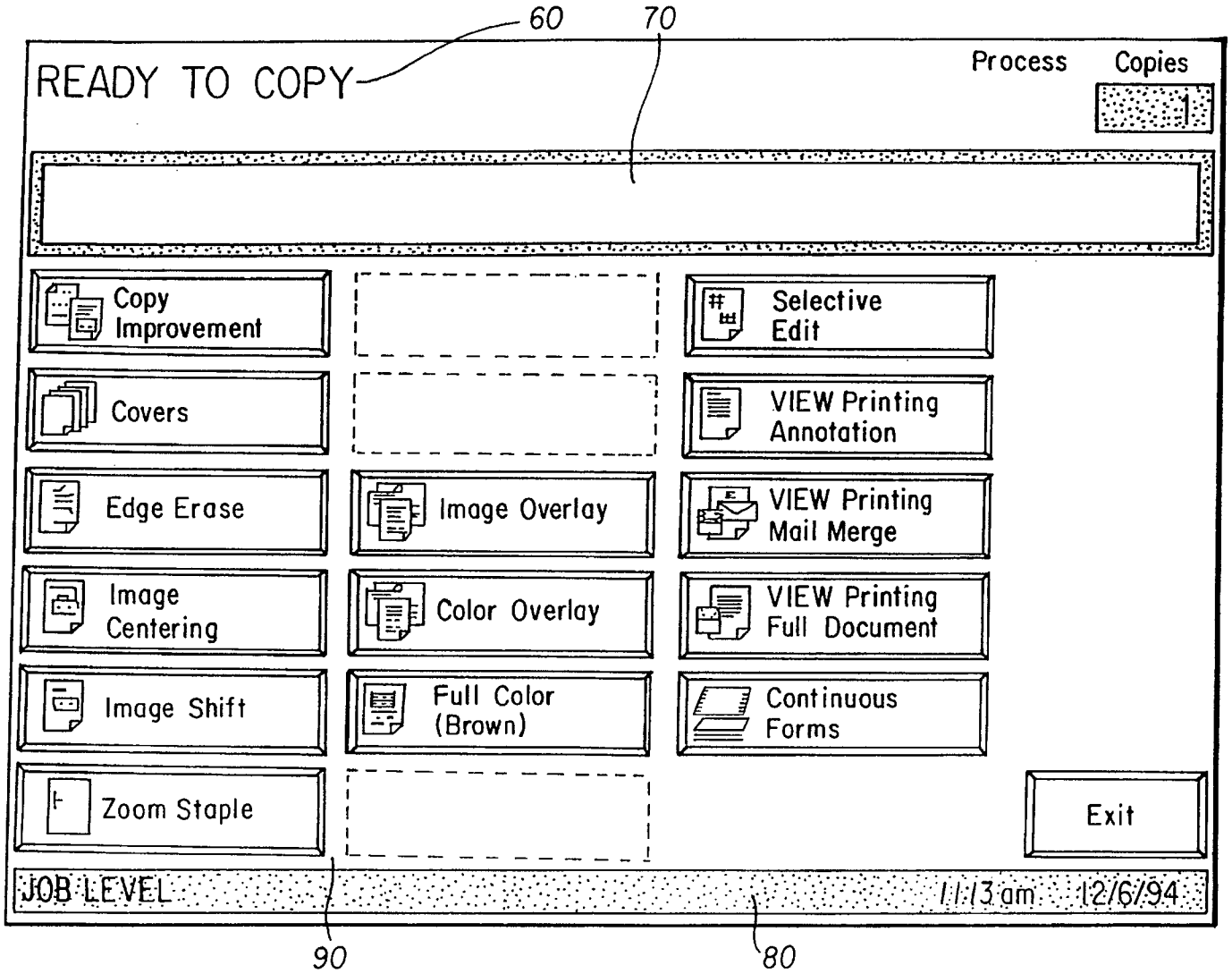
FIG. 7 is a view of another operating features selection screen addressed on the FIG. 1 apparatus display device.
Figure 8:
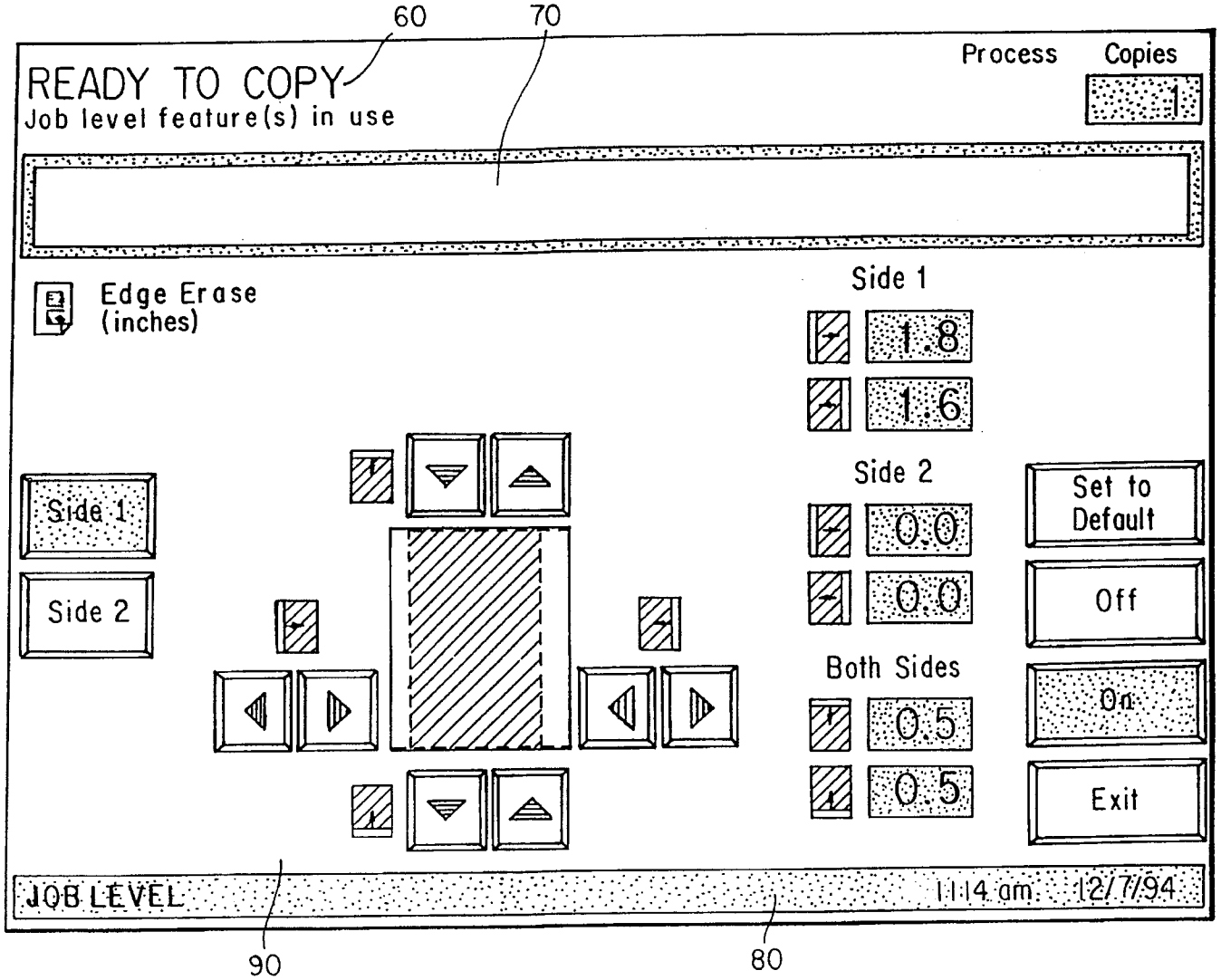
FIG. 8 is a view of yet another operating features selection screen addressed on the FIG. 1 apparatus display device.

FIG. 7 illustrates an additional operating features selection screen (job level) addressed onto device 11 by the operator actuating the job level key 51 of the keyboard 50. In this context, the term job level refers to operating features that the operator can select to pertain to each page of output copy. To further illustrate, FIG. 8 shows the edge erase work screen addressed onto display device 20 in response to the operator touching the edge erase selection region of job level screen shown in FIG. 7. After the operator enters the desired erase instructions, via the FIG. 8 erase screen, the exit or job level regions of that screen are touched to return to the job level features selection screen, which now shows "edge erase" highlighted (selected), see FIG. 9.

Figure 9:
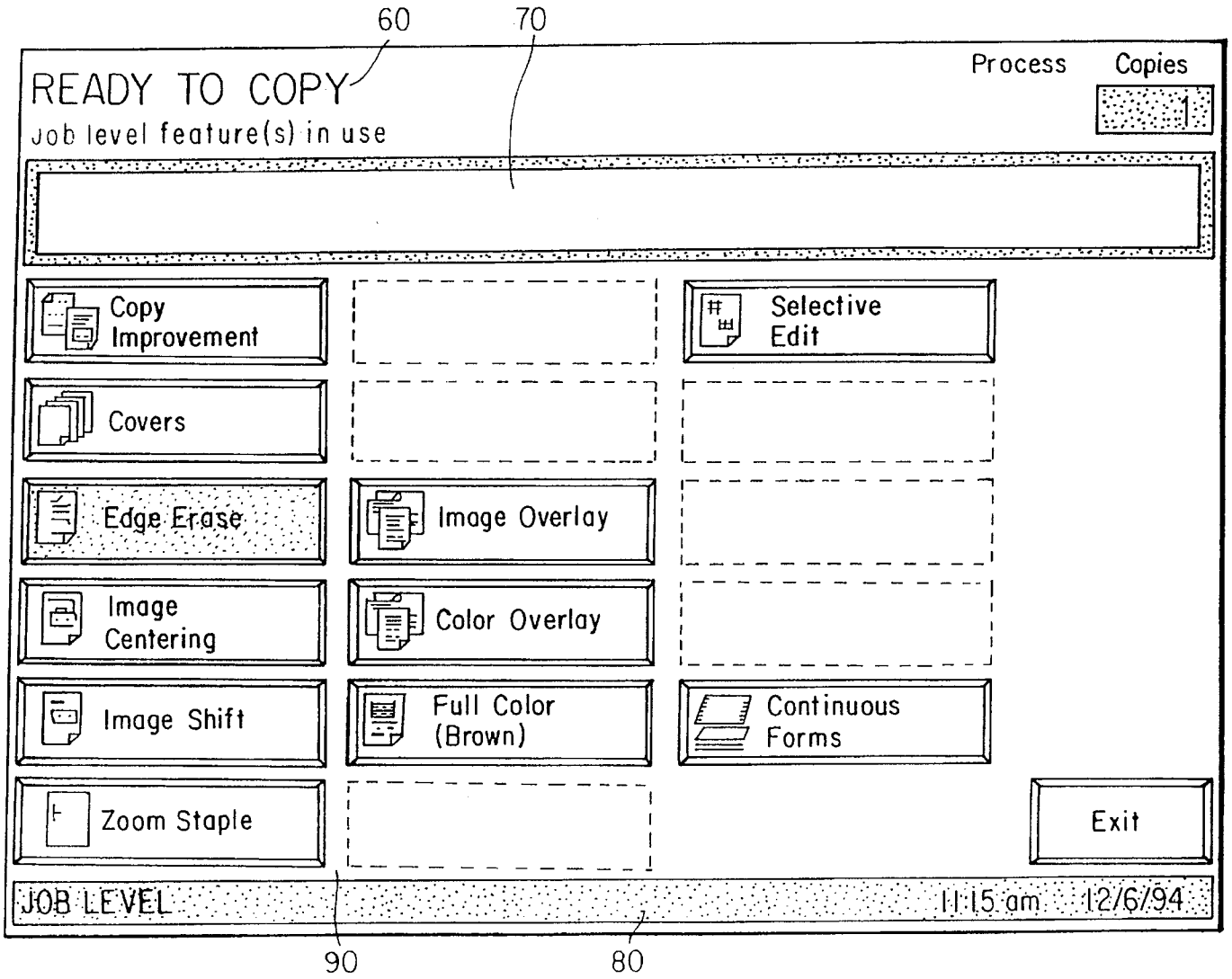
FIGS. 9–11 are views of still further operating features selection screens addressed onto the display device of the FIG. 1 apparatus.
Figure 10:
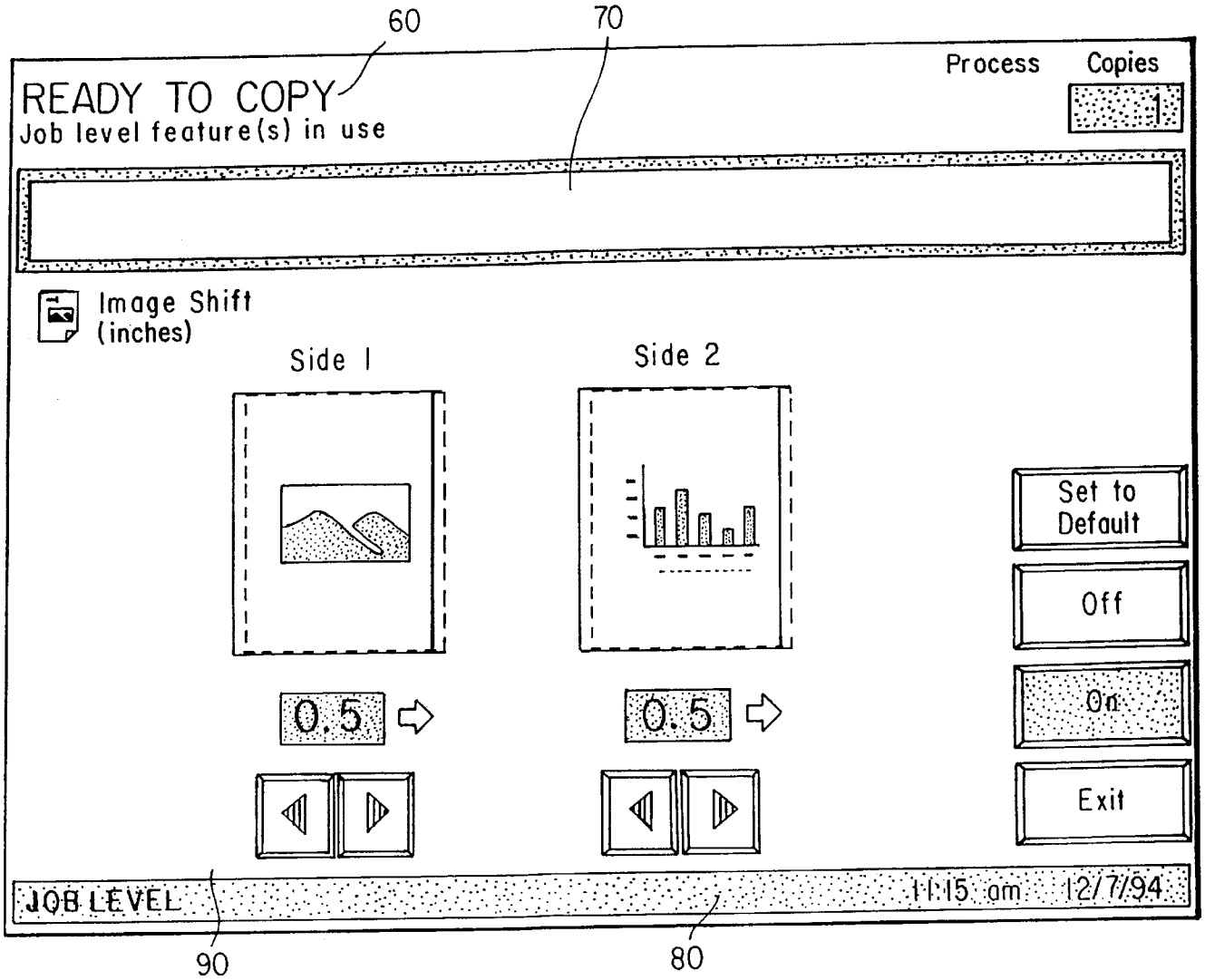
Figure 11:
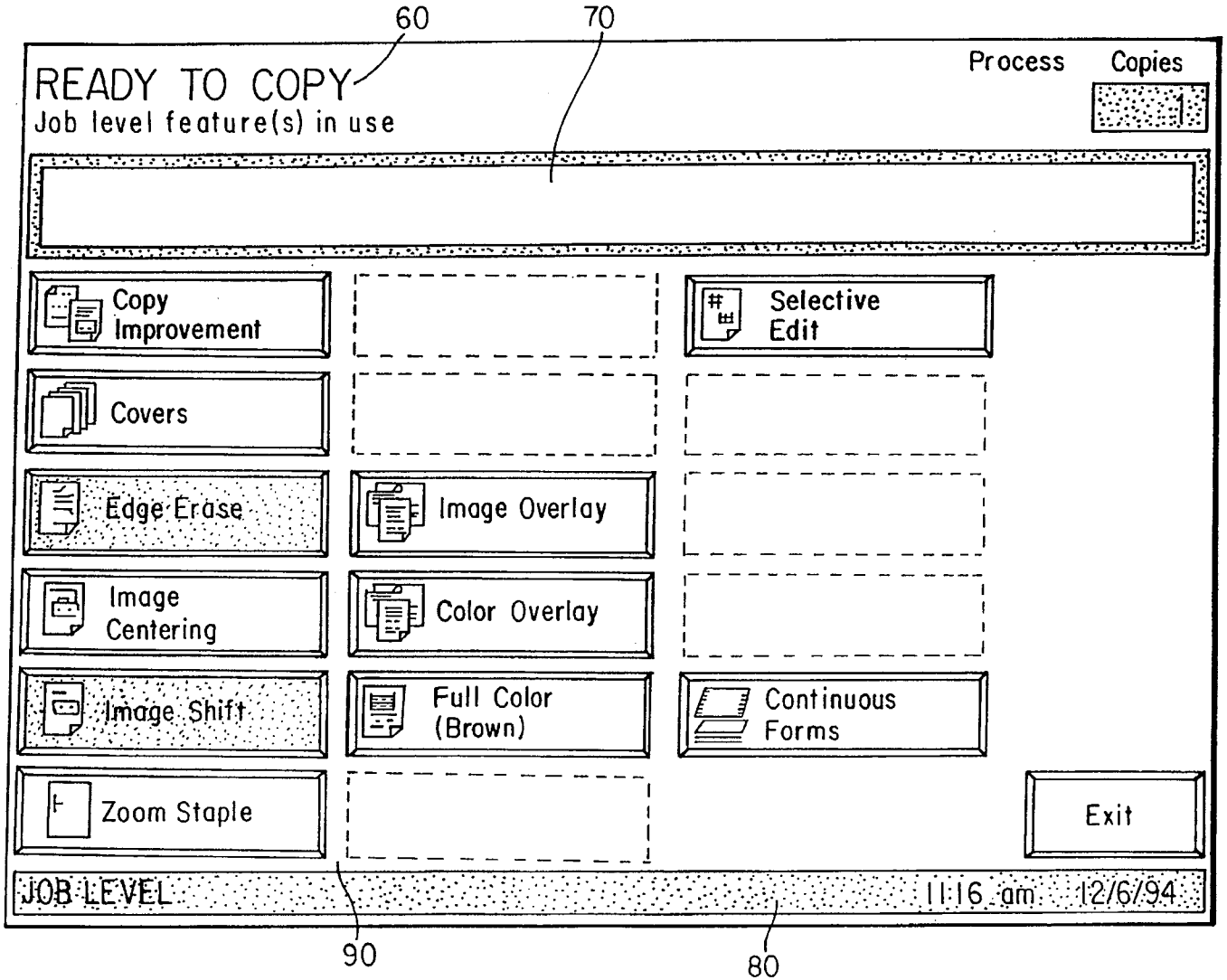

As a further illustration, FIG. 10 shows an image shift work screen addressed onto display device 20 in response to the operator next touching the image shift region on the job level selection screen of FIG. 9. The operator again enters the desired instructions (adjustment of image position), and thereafter touches the exit or job level regions of the image shift screen (FIG. 10) to return to the job level selection screen, (which, as illustrated in FIG. 11), now shows the image shift region highlighted. It will be appreciated that many more operating feature selections are available to the operator, e.g., copy improvement, covers . . . continuous forms, by addressing further instruction subscreens to the display device 20, by touch of regions on the job level selection menu screen (e.g., FIG. 11).

After the operator has completed the detail selection process for setting up a job with predetermined operating features, the copy job can be effected by actuating the start key 55 on panel 50. More particularly, as operating features are selected by the operator (or allowed to exist in the case of nominal standard features), the display device 11 generates corresponding selection signals, that are detected and stored by logic and control L. When the selections are complete and copy start actuated, the logic and control operates the apparatus 10 in accord with fixed parameters, e.g., from ROM memory and in accord with job selected parameters stored in other logic memory, e.g., RAM memory. However, it often occurs that the operator's job may involve a possible re-ran, e.g., if more copy sets might be subsequently requested. In this situation, the experienced operator would wish to "save the job", e.g., record the data corresponding to the signals set representing the job operating feature selections in a non-volatile memory location, together with a job number data code for retrieving the signals set. The operator may wish to make a "save the job" decision before or after the copy ran, but would need to do so before the job data was replaced or erased in memory of logic unit L.

Figure 12:
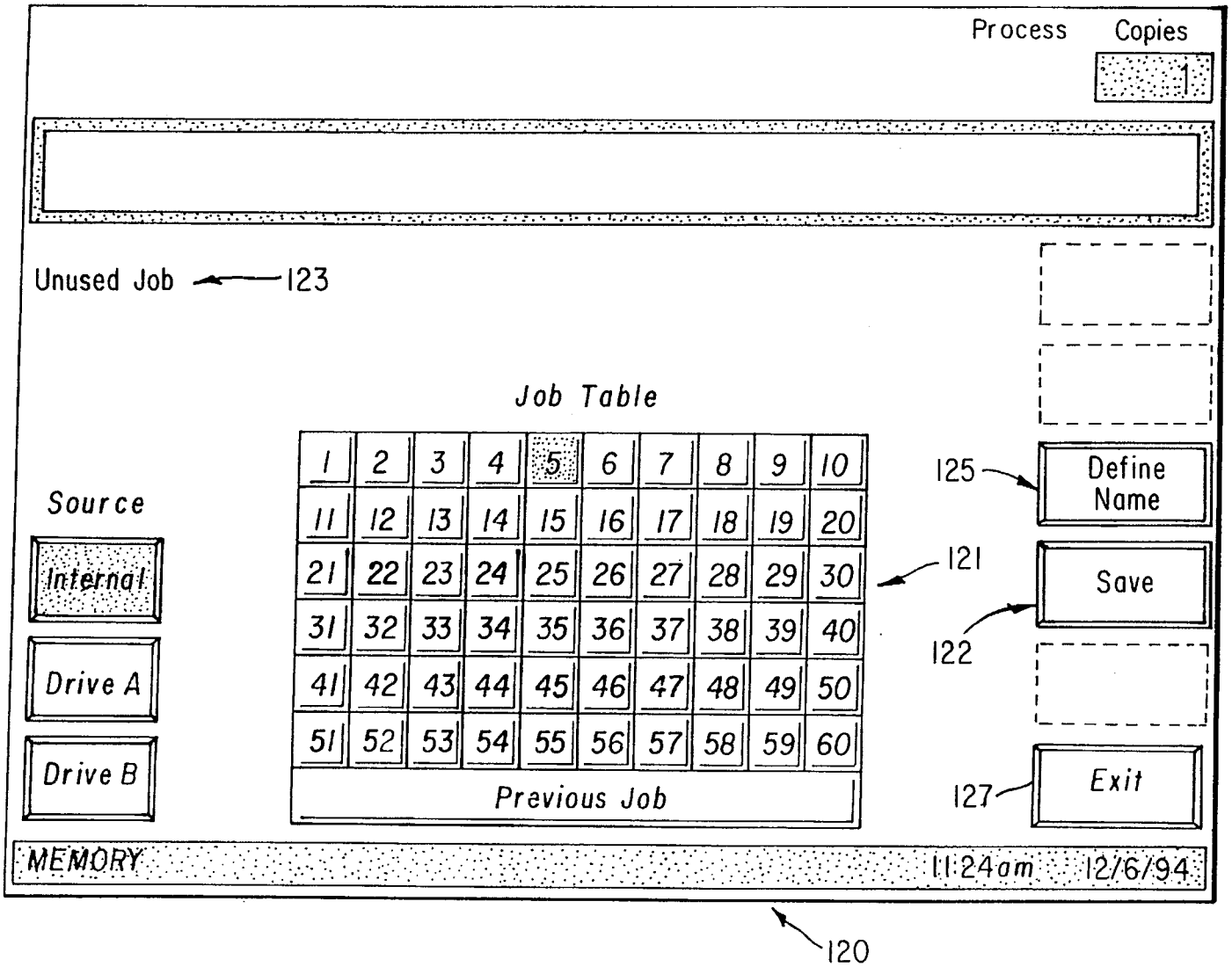
FIG. 12 is a view of a job memory screen, according to the invention, addressed onto the display device of the FIG. 1 apparatus.

FIG. 12 shows a job store/retrieve memory screen 120 addressed onto the display device 20 by the operator actuating memory key 53 on hard panel 50, which will allow the operator to save the job in accord with the invention. Thus, FIG. 12 reflects that the operator has selected, in job table touch keyboard 121, to store the operating feature signals for the above discussed job, as job number "5" (identified as an unused job in the memory status region 123 of screen 120) If the "save" region 122 of the FIG. 12 screen is touched, the data representing the job selections signals set will be recorded from temporary memory (e.g., RAM) to a permanent memory portion of logic unit L (e.g., non-volatile memory or media), together with identifying retrieval code data corresponding to the job number ("5"). A job run could then be commenced by returning to the standard features screen, via the exit button 127, and actuating the start key 55.

However, in accord with a particularly preferred aspect of the present invention, the foregoing job can also be stored with a job description that the operator will recognize more easily in the future than the bared designation "job 5".

Figure 13:
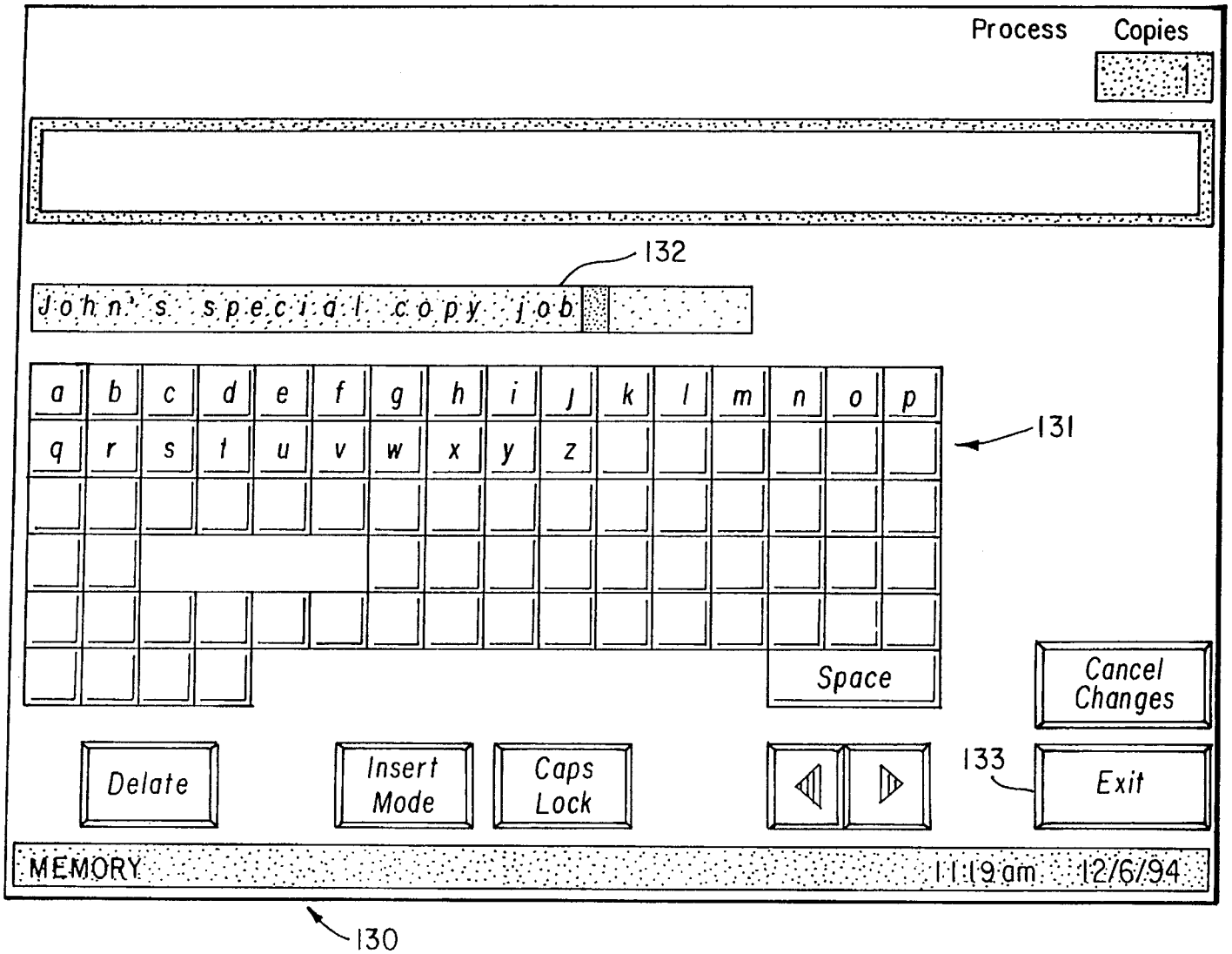
FIG. 13 is a view of a job naming screen according to the invention addressed onto the display device of the present invention.
Figure 14:
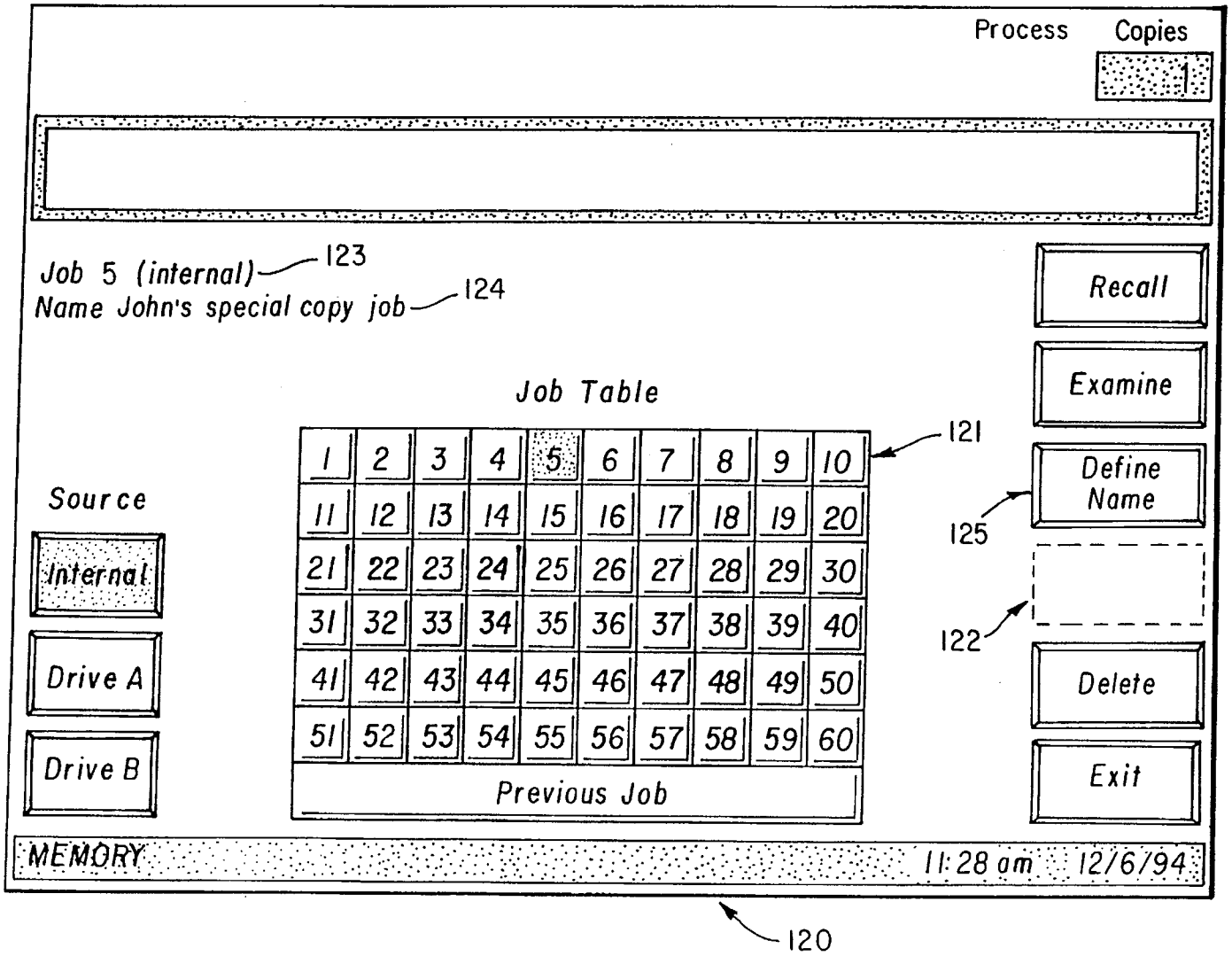
FIGS. 14–17 are further views similar to FIGS. 12 and 13 but showing other stages of job name definition and job storage and retrieval according to the present invention.

Thus, by touching the "define name" region 125 on the store/retrieve memory screen shown in FIG. 12, the job naming screen shown in FIG. 13 can be addressed from memory, e.g., ROM of logic unit L, onto display device 20. As shown, the job naming screen comprises a keyboard 131, having e.g., the typical alpha-numeric characters for word/phrase typing, as well as punctuation characters. By sequentially touching individual character regions on the keyboard of the naming screen sequentially, a word/phrase job description (or other such recognizable character string) can be recorded, and is displayed in a job description region 132 on screen 130. After completion of the recording of a satisfactory word/phrase description for the job, e.g., "John's special copy job", the operator touches the exit region 133 of the naming screen 130. The job store/retrieve memory screen 120 reappears as illustrated in FIG. 14, now showing (in status region 123) that the memory region addressed is allocated to job number 5 and also showing, in name region 124, the job description name just recorded on screen 130. The operator now touches the "save" region 122 and the features selections signals set data, the job number code data, and the word/phrase job description data are all stored in mutually retrievable association in non-volatile memory of logic L. Therefore, at a subsequent time the operator can recognize and retrieve this job in a convenient, reliable manner by actuating memory key 53 to address a screen such as shown in FIG. 12 to display device 20. The job key regions of the job table can then be actuated to scan the stored jobs and when the job table number 5 region is addressed the job description shown at 124 in FIG. 14 will appear to inform or confirm to the operator that this is the desired job set-up for rerun.

Figure 15:
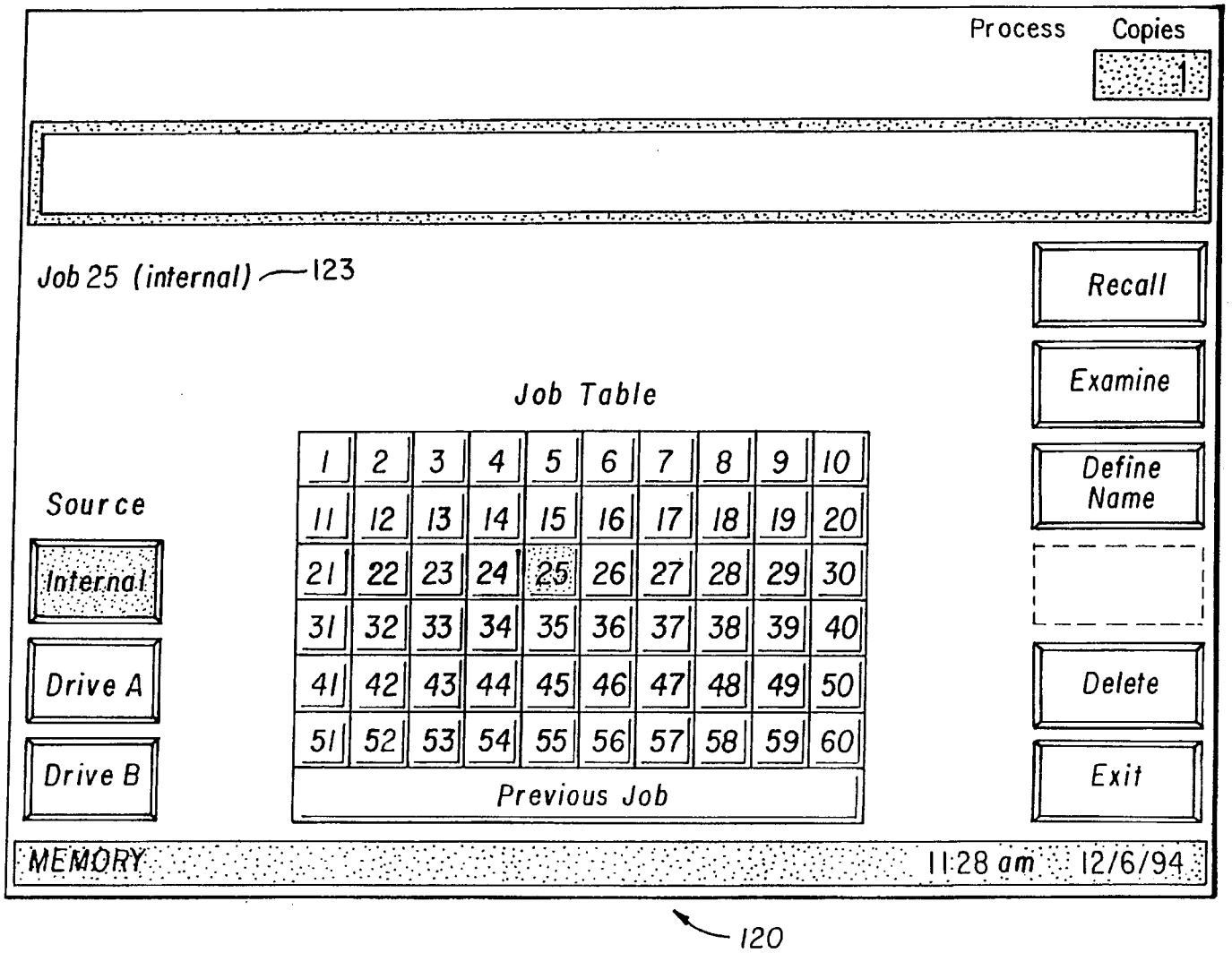
Figure 16:
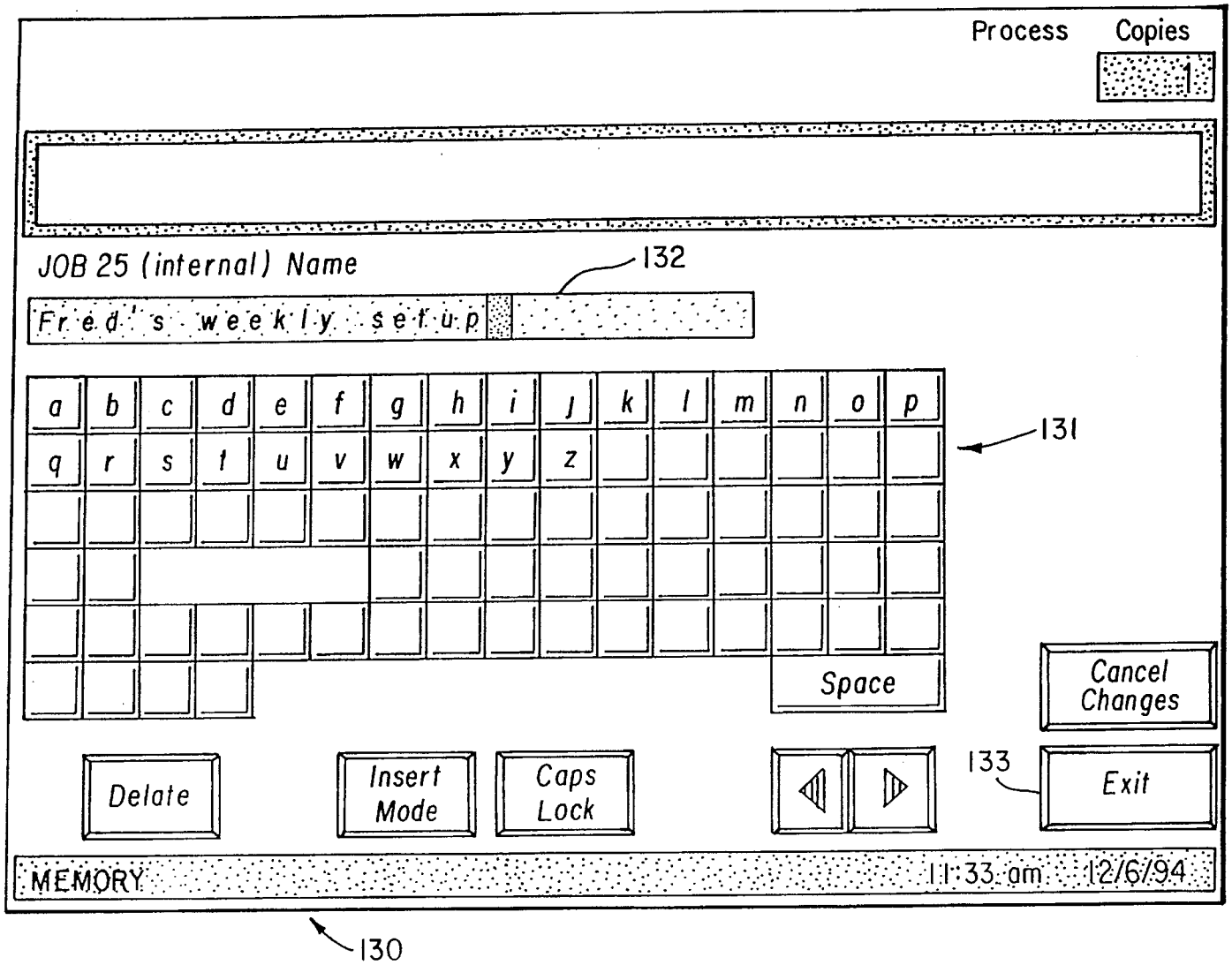
Figure 17:
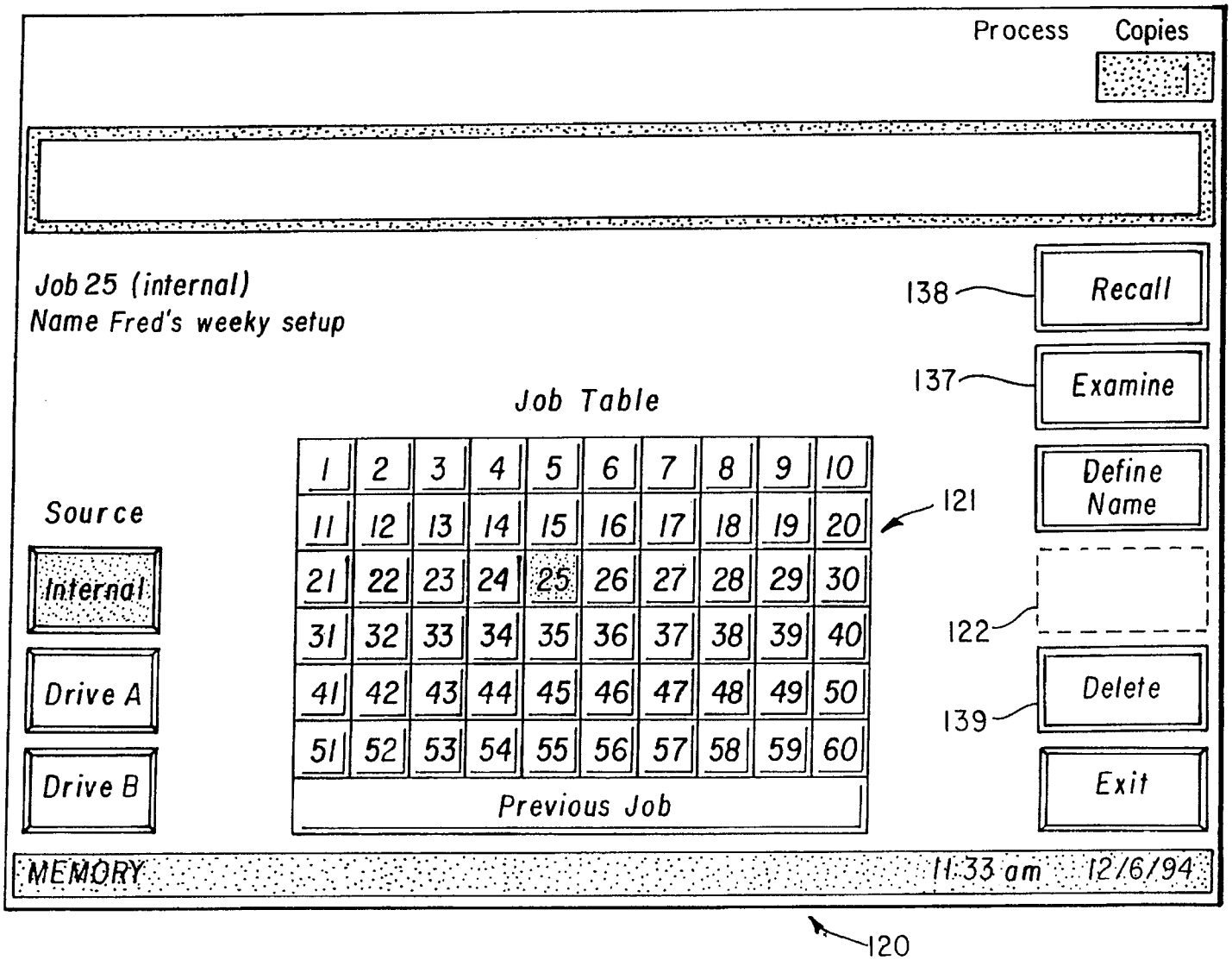

The above described naming procedure, according to the invention, can also be employed advantageously to name a job previously saved in memory with the bare job number e.g., "25". Thus, FIG. 15 shows the screen 120 addressed onto display device 20 (by actuation of memory hard key 53), with the key region "25" having been actuated and indicating in memory status region 123, that job 25 is stored there. Advantageously, the operator can then touch the "Examine" region 137 to review summarizations of the standard level, job level and page level features that have been selected for job "25", by the system described in concurrently filed U.S. application Ser. No. 08/398,231, entitled "IMPROVED SYSTEM AND METHOD FOR JOB SET UP SUMMARIZING IN REPROGRAPHIC APPARATUS", by Smith, Altreith and Beaudet, which is incorporated herein by this reference. After confirming job 25, the operator can touch "define name" region 125 of screen 120 to cause the address of job naming screen 130 onto display device 20. The touch region keyboard 131 can now be operated to record a word/phrase name description for job 25, which is displayed in region 132, below the job number, see FIG. 16. The job description "Fred's weekly set-up" is thereafter saved with the job number and the data signals representing the selected operating features of the set-up, by actuating the exit region 133 of screen 130, to return to store/retrieve memory screen 120 shown as now updated in FIG. 17. Actuation of save region 122 on screen 120 completes the naming update as previously described.

The operator can also retrieve a saved job, revise and rename it, e.g., "Fred's weekly set-up, revised 1/6/95". To accomplish this, the operator addresses the memory screen of FIG. 17 to device 11, by actuating the hard key 53. The button region "25" of touch keyboard 121 on that screen is then actuated to address the desired saved job in memory. Next, the "Recall" touch region 138 is actuated to retrieve the entire signals set for saved job "35" from the hard memory of Unit L and transfer it to RAM memory as a current job (with a standard features screen, such as FIG. 5, being displayed with the saved job features indicated thereon). The operator then manipulates the screens and selections, in the manner first described above regarding a new job set up, to effect desired revisions. Upon completion of revisions the memory hard key 53 is actuated to return to a memory screen, such as FIG. 14. The define name operation is actuated as with a new job and the revised word/phrase job description is typed on the keyboard 131 shown in FIG. 16. After return to the memory screen the old job "25" can be replaced in memory by actuating job key 25 and actuating the "Delete" touch region 139 (see FIG. 17). The new (revised) job is then allocated to job number "25" together with its revised job description, "Fred's weekly set up revised, 1/6/95", by actuating the "Save" region 122, which in this instance will be highlighted and available because the old job has been deleted from hard memory.

While the example job descriptions herein comprise mainly word/phrase character strings it will be appreciated by those skilled in the art that other character strings may be devised and recorded in patterns recognizable to an operator as a job description for a particular job, e.g., using abbreviations or acronyms. Thus, the terms "words" and "phrases" as used herein are intended to include such other operator—recognizable character strings.

The invention has been described in detail with particular reference to preferred embodiments, but it will be understood that variations and modifications can be effected within the spirit and scope of the invention as set forth in the claims.

I claim:

1. In reproduction apparatus of the kind having a plurality of operating features for producing copy jobs and an operator control communication interface including: (1) display means for indicating selectable operating features on a selection screen, (2) signal means for generating a set of signals in accord with selections on the selection screen of said display means, (3) control means responsive to said signals set for actuating said apparatus to produce a copy job in accord with said selections and (4) memory means for storing copy data including the signal sets indicative of the selected job operating features and a job number retrieval code, the improvement wherein said control communication interface further comprises:

(i) means for addressing said display means with a job naming screen indicating a plurality of selectable job description characters;

(ii) means responsive to operator selections of said job description characters for recording a multicharacter job description;

(iii) means for storing said recorded job description in said memory means, in association with the related job number retrieval code and corresponding operating features signals set; and (iv) means, responsive to address by said job number retrieval code, for displaying said recorded job description.

2. The invention defined in claim 1 wherein said job description characters include alphanumeric characters and punctuation characters such that said job description can comprise words and phrases.

3. The invention defined in claim 1 wherein said control communication interface comprises means for addressing said display means to display a store/retrieve memory screen indicating a plurality of operator selectable job code numbers and a region showing selected job codes in association with their recorded job descriptions.

4. The invention defined in claim 3 wherein said display means comprises a touch-activated video screen having means for displaying different video fields respectively showing operating feature selections, job description character selections and job code number selection.

5. The invention defined in claim 4 wherein said operator control communication interface further comprises a hard keyboard, wherein said video screens for operating feature selections and for job code number selections are activated for display via said keyboard and wherein said video screen for job description character selection is activated for display by touch address of a region on said store/retrieve memory screen.

6. The invention defined in claim 5 wherein said mean for storing said recorded job description character data in association with corresponding job number code data and operating features selections signals set is activated by touch address of a region of said store/retrieve memory screen.

7. The invention defined in claim 6 wherein said store/retrieve memory screen includes a plurality of touch address job key regions designating job numbers and said means for displaying job descriptions with related job number is activated by touch address of said job key regions.

8. The invention defined in claim 1 wherein said display means comprises a touch activated screen addressable to provide different video fields presenting job operating features and job description character selections.

9. In reproduction apparatus including a plurality of operating reproduction features and an operator control communication interface having a display screen for operator selections, an improved method of job description and storage comprising the steps:

(i) displaying a screen having selectable operating reproduction features;

(ii) selecting on said screen a plurality of operating features for a predetermined job;

(iii) generating a job signals set representing said selected job operating features;

(iv) generating a job number for said predetermined job;

(v) displaying a job naming screen having selectable job description characters;

(vi) selecting on said naming screen a plurality of characters to form a visually readable description for said predetermined job;

(vii) storing said job signals set in memory in retrievable association with said job number and said readable job description.

10. The method defined in claim 9 wherein the step of generating a job number includes displaying a job store/retrieve memory screen having a plurality of selectable job number regions and touch addressing a selected job number region.

11. The method defined in claim 10 wherein the display of job description characters is activated by touch addressing a name define region on said store/retrieve memory screen.

12. The method defined in claim 11 wherein a stored job description is displayed on the store/retrieve memory screen with its associated job number, when retrieved by touch address of a job key region on that memory screen.

13. In reproduction apparatus including a plurality of operating features and an operator control communication interface including an interactive display, a logic control and a memory for storing a plurality of stored job set up signals sets, an improved method for job retrieval comprising the steps of:

(i) addressing a store/retrieve memory screen containing a plurality of activatable job identification number regions onto the display;

(ii) selecting a job number region to retrieve a job set up signals set from memory;

(iii) addressing a job naming screen having a plurality of selectable job description characters onto the display;

(iv) selecting a plurality of such description characters to form an operator recognizable job description; and (v) storing the job signals set in memory in retrievable association with the job description formed by selected description characters.

14. The method of claim 13 further including the step of viewing summarizations of selected job operating features on the display after retrieving the job set up signals from memory.

* * * * *